US010294698B1

(12) United States Patent
Bartak

(10) Patent No.: US 10,294,698 B1
(45) Date of Patent: May 21, 2019

(54) RESTRAINING DEVICE

(71) Applicant: Terry Bartak, Page, NE (US)

(72) Inventor: Terry Bartak, Page, NE (US)

( * ) Notice: Subject to any disclaimer, the term of this patent is extended or adjusted under 35 U.S.C. 154(b) by 0 days.

(21) Appl. No.: 15/586,904

(22) Filed: May 4, 2017

Related U.S. Application Data

(60) Provisional application No. 62/332,621, filed on May 6, 2016.

(51) Int. Cl.
*E05B 75/00* (2006.01)
*F41B 15/00* (2006.01)
*E05B 73/02* (2006.01)
*E05B 67/00* (2006.01)

(52) U.S. Cl.
CPC ..... *E05B 75/00* (2013.01); *E05B 67/003* (2013.01); *E05B 73/02* (2013.01); *F41B 15/00* (2013.01)

(58) Field of Classification Search
CPC ..... E05B 75/00; E05B 67/003; E05B 73/02; E05B 15/0046; F41B 15/00
USPC ..... 70/15–17, 30, 49, 225, 226, 233
See application file for complete search history.

(56) References Cited

U.S. PATENT DOCUMENTS 1,475,256 A * 11/1923 Belair ..... E05B 67/003 24/134 R
1,620,749 A * 3/1927 Bartak ..... E05D 13/06 292/175
2,919,676 A * 1/1960 Schneider ..... A01K 27/004 119/796
3,661,187 A 5/1972 Caveney et al.
4,086,795 A * 5/1978 Foster ..... B62H 5/003 70/233
6,368,262 B1 * 4/2002 Willoughby ..... A01K 15/04 119/796
6,575,799 B1 6/2003 Stimpson et al.
6,609,399 B1 * 8/2003 Daniels, Jr. ..... B62H 5/003 70/14
7,784,313 B2 * 8/2010 Wyers ..... E05B 67/003 70/14
8,607,742 B2 * 12/2013 Lash ..... A01K 27/009 119/796
9,663,975 B2 * 5/2017 Castro ..... E05B 67/24
2004/0256865 A1 * 12/2004 Rogatnev ..... E05B 39/00 292/315
2012/0222457 A1 * 9/2012 Kriesel ..... E05B 75/00 70/16

FOREIGN PATENT DOCUMENTS

SU 921551 * 4/1982

* cited by examiner

*Primary Examiner* — Suzanne L Barrett
(74) *Attorney, Agent, or Firm* — Suiter Swantz pc llo

(57) ABSTRACT

A non-lethal restraining device includes an extendable restraining strap retained within a device body until deployed, when the extendable restraining strap is then looped over a person. A biasing element allows the extendable restraining strap to be tightened once it has been fully deployed and looped around a person's body to restrict the person's movement. When the extendable strap is tightened around the person's body, the device provides control points to direct and manipulate the person safely.

20 Claims, 20 Drawing Sheets

RESTRAINING DEVICE

PRIORITY

The present application claims the benefit under 35 U.S.C. § 119(e) of U.S. Provisional App. No. 62/332,621 (filed May 6, 2016), which is incorporated herein by reference.

FIELD OF THE INVENTION

Embodiments of the inventive concepts disclosed herein are directed generally toward restraining devices and more particularly toward a first-contact, non-lethal device for restraining an uncooperative person.

BACKGROUND

During aggressive confrontations, such as confrontations between police officers and a criminal suspect, police officers have few options for non-lethal intervention. Even generally non-lethal options carry substantial risks. In situations where a person needs to be restrained to prevent injury to himself or others, a police officer may need to apply substantial physical force to place the person in a position to be handcuffed or otherwise rendered harmless; such force may be physically injurious to the person.

What is needed is a non-lethal device for restraining a person without an injurious amount of physical force.

SUMMARY

In one aspect, embodiments of the inventive concepts disclosed herein are directed to a non-lethal device for restraining a person without an injurious amount of physical force. The device includes an extendable restraining strap. The extendable restraining strap is retained within a device body until deployed, when the extendable restraining strap is then looped over a person. The device includes a biasing element that allows the extendable restraining strap to be tightened once it has been fully deployed. When the extendable strap is looped around a person, tightening the extendable strap around the person's body (or some portion of the person's body) restricts the person's movement without injury.

In a further aspect, when the extendable strap is tightened around a person's body, the device provides control points to direct and manipulate the person safely.

It is to be understood that both the foregoing general description and the following detailed description are exemplary and explanatory only and should not restrict the scope of the claims. The accompanying drawings, which are incorporated in and constitute a part of the specification, illustrate exemplary embodiments of the inventive concepts disclosed herein and together with the general description, serve to explain the principles.

BRIEF DESCRIPTION OF THE DRAWINGS

The numerous advantages of the embodiments of the inventive concepts disclosed herein may be better understood by those skilled in the art by reference to the accompanying figures in which.

DETAILED DESCRIPTION

Figure 1:
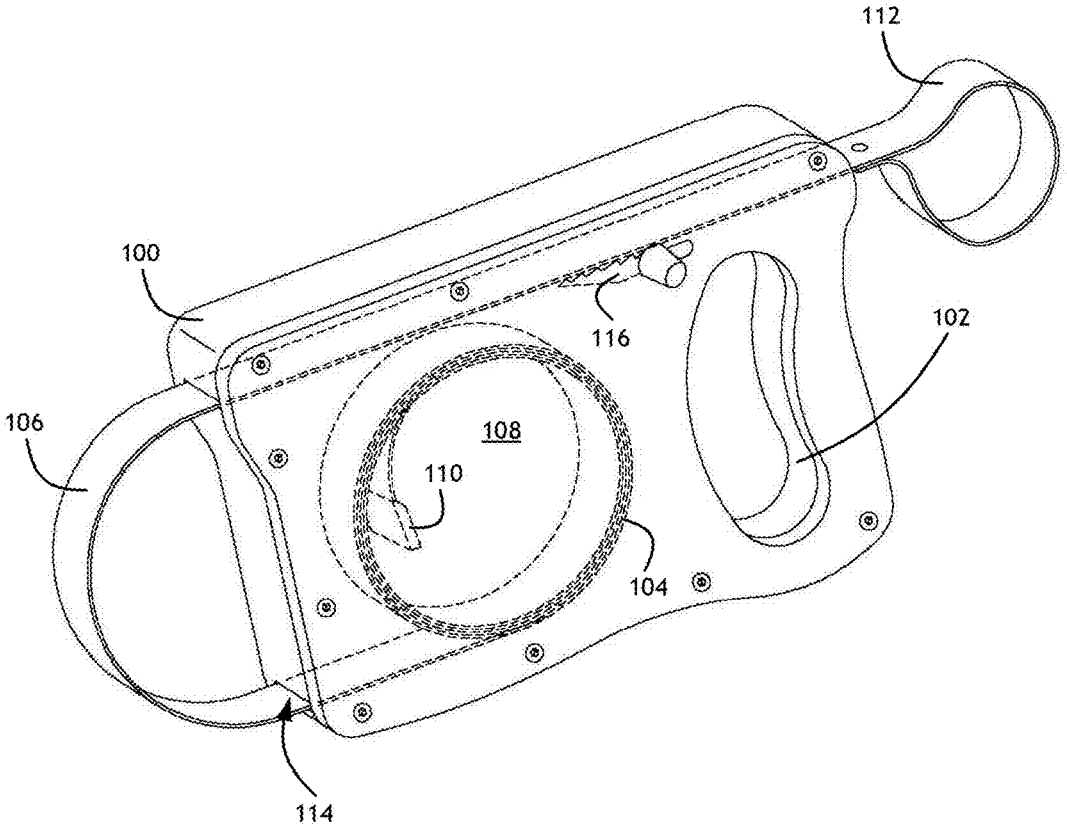
FIG. 1 shows a perspective view of an exemplary embodiment of a restraining device according to the present disclosure.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to a restraining device for rendering a person substantially harmless to himself and others with a minimal application of physical force.

Referring to FIG. 1, a perspective view of an exemplary embodiment of a restraining device according to the present disclosure is shown. The restraining device includes a body 100 defining a handle 102 and a strap cavity 108. A flexible, extendable strap 104 is wound or coiled inside the strap cavity 108 with a portion extending through a strap endstop retaining element 114, forming an extension loop 106, and passing back through the body 100. The device includes a tightening handle 112 or grip portion attached to the free end for tightening the flexible, extendable strap 104; the tightening handle 112 may comprise a looped portion of the flexible, extendable strap 104 or a separate artifice connected to the flexible, extendable strap 104. The strap endstop retaining element 114 allows the flexible, extendable strap to pass through unopposed but prevents an endstop portion 110 from passing through. A biasing element 116 allows the flexible, extendable strap to pass though as the handle 12 is pulled, but prevents the flexible, extendable strap from passing through in the opposite direction unless the biasing element 116 is disengaged.

The flexible, extendable strap 104 may comprise a metal band, a polycarbonate strap, woven nylon, or some other material sufficiently flexible to be wound inside the strap cavity 108, and sufficiently strong to restrain a person around the person's arms and upper body, legs, wrists, or any other portion of the body.

Figure 2:
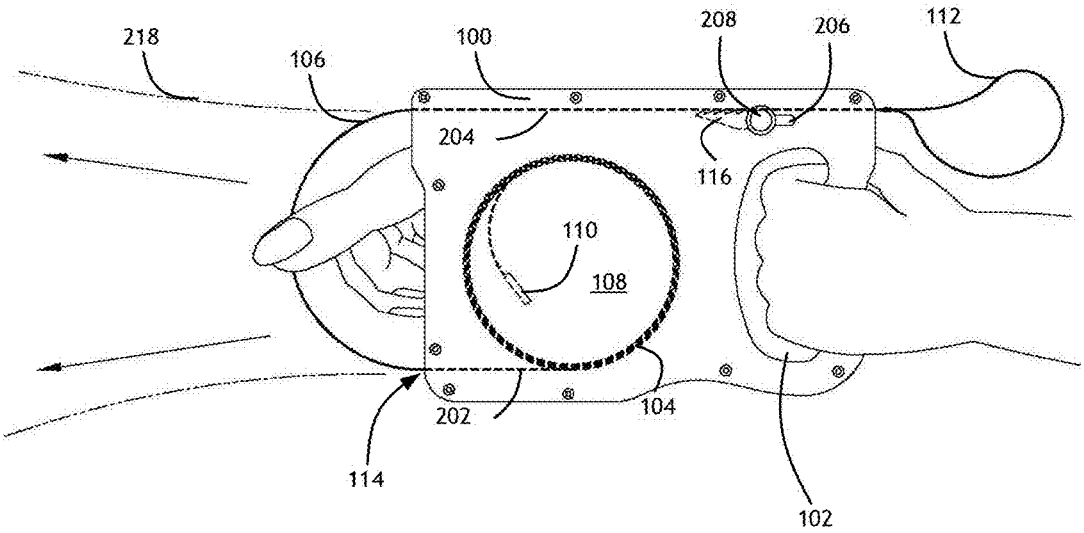
FIG. 2 shows an environmental side view of an exemplary embodiment of a restraining device according to the present disclosure.
Figure 3:
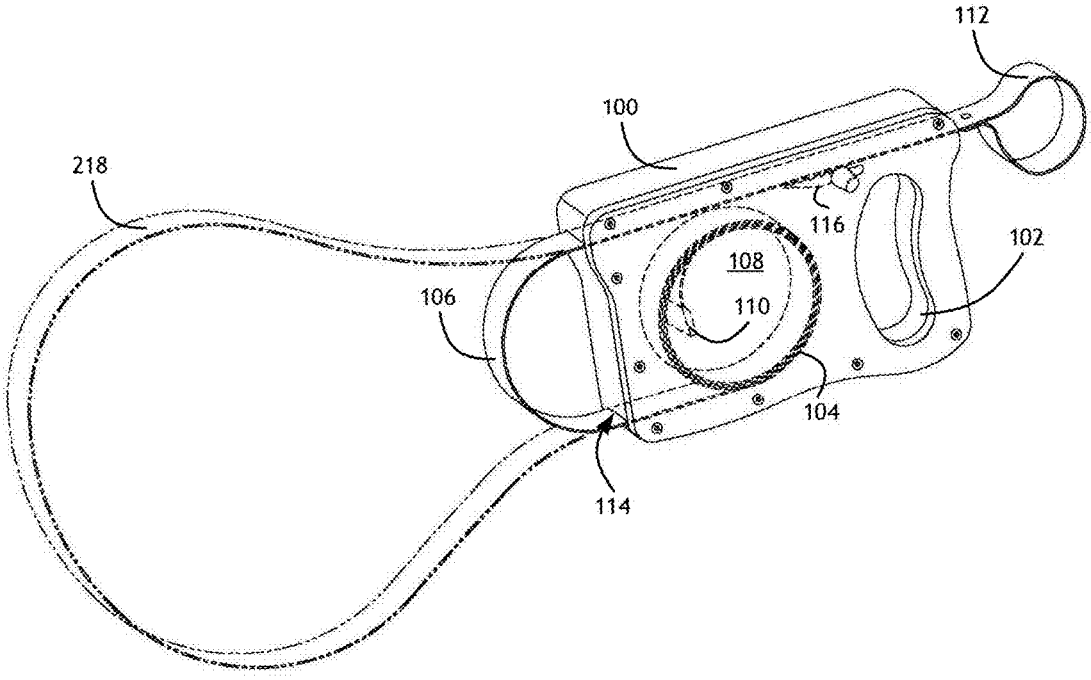
FIG. 3 shows a perspective view of an exemplary embodiment of a restraining device according to the present disclosure.

Referring to FIGS. 2 and 3, an environmental side view and perspective view of an exemplary embodiment of a restraining device according to the present disclosure are shown. The body 100 further defines an extending loop channel 202 that guides the flexible, extendable strap 104 out of the body 100 and terminates with the endstop retaining element 114. The body 100 further defines a retracting loop channel 204 that guides the flexible extendable strap 104 through the body 100, past the biasing element 116, into the tightening handle 112.

In some embodiments, the biasing element 116 comprises a spring biased tooth device connected to a disengaging lever 208 that allows the biasing element 116 to be disengaged by sliding the biasing element 116 along a biasing disengaging channel 206 defined by the body 100. The biasing disengaging channel 206 may include a locking portion that allows the biasing element 116 to be locked in a disengaged position.

While a toothed biasing element 116 is shown, other biasing elements 116 are envisioned. Any device providing a sufficient mechanical resistance to the flexible, extendable strap 104 to prevent it from loosening, while at the same time allowing the user to tighten the flexible, extendable strap 104 by pulling the tightening handle 112 may be utilized. Further exemplary embodiments are shown herein.

A user places the device in a deployed configuration by, in one embodiment, pulling on the extension loop 106. Pulling on the extension loop causes the flexible, extendable strap 104 to unwind and exit the strap cavity 108 through the extending loop channel 202 and strap endstop retaining element 114 until the endstop portion 110 engages the endstop retaining element 114. The biasing element 116 prevents the flexible, extendable strap 104 from being pulled through the retracting loop channel 204. When fully extended, the flexible, extendable strap 104 forms a restraining loop 218.

In at least one embodiment, the flexible, extendable strap 104 may be spring actuated to deploy into a restraining loop 218. For example, where the flexible, extendable strap 104 is a metal band, the metallurgical properties of the metal band may allow it to automatically deploy due to the spring nature of the metal band when coiled within the strap cavity 108. Alternatively, or in addition, a spring device disposed on the body may automatically deploy the flexible, extendable strap 104.

Figure 4:
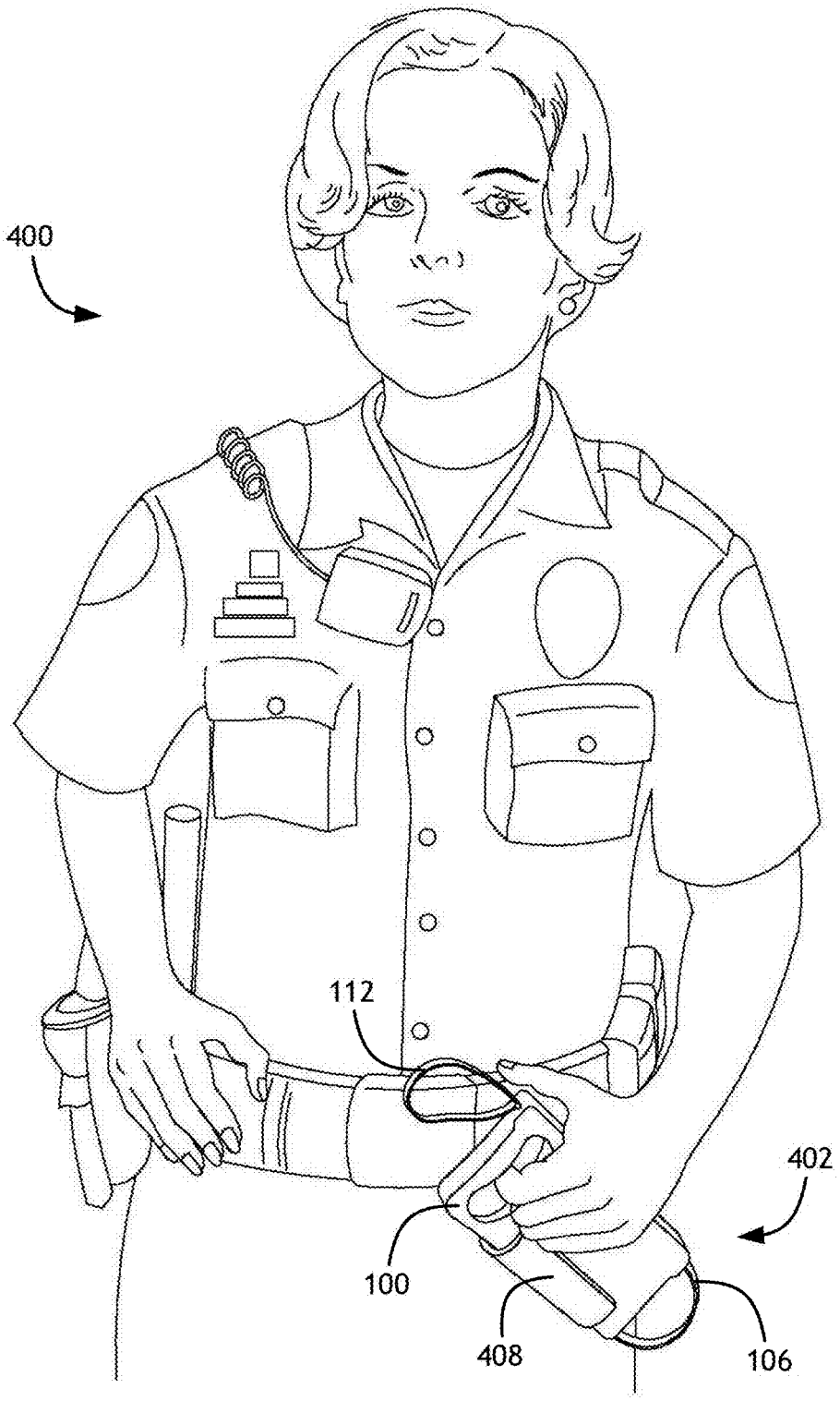
FIG. 4 shows an environmental view of a restraining device according to the present disclosure.
Figure 5:
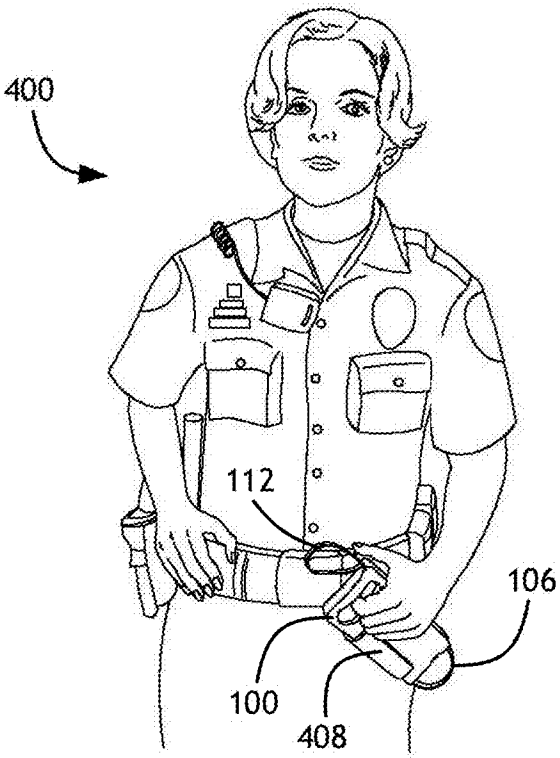
FIG. 5 shows another environmental view of a restraining device according to the present disclosure.
Figure 5:
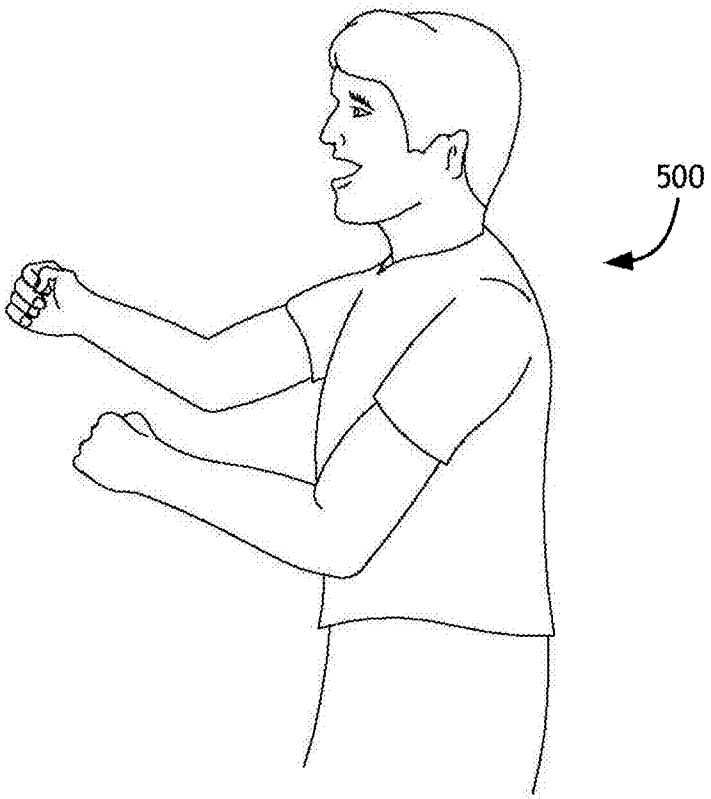

Referring to FIGS. 4 and 5, environmental views of a restraining device according to the present disclosure are shown. A police officer 400 carries a restraining device 402 where the body 100 of the restraining device 402 engages a holster 408 or clip configured to hold the restraining device 402 in an orientation that allows for a quick release of the restraining device 402 with the extension loop 106 and tightening handle 112 in positions to be quickly accessible to the hands of the police officer 400 when an unarmed, uncooperative person 500 requires restraint.

Figure 6:
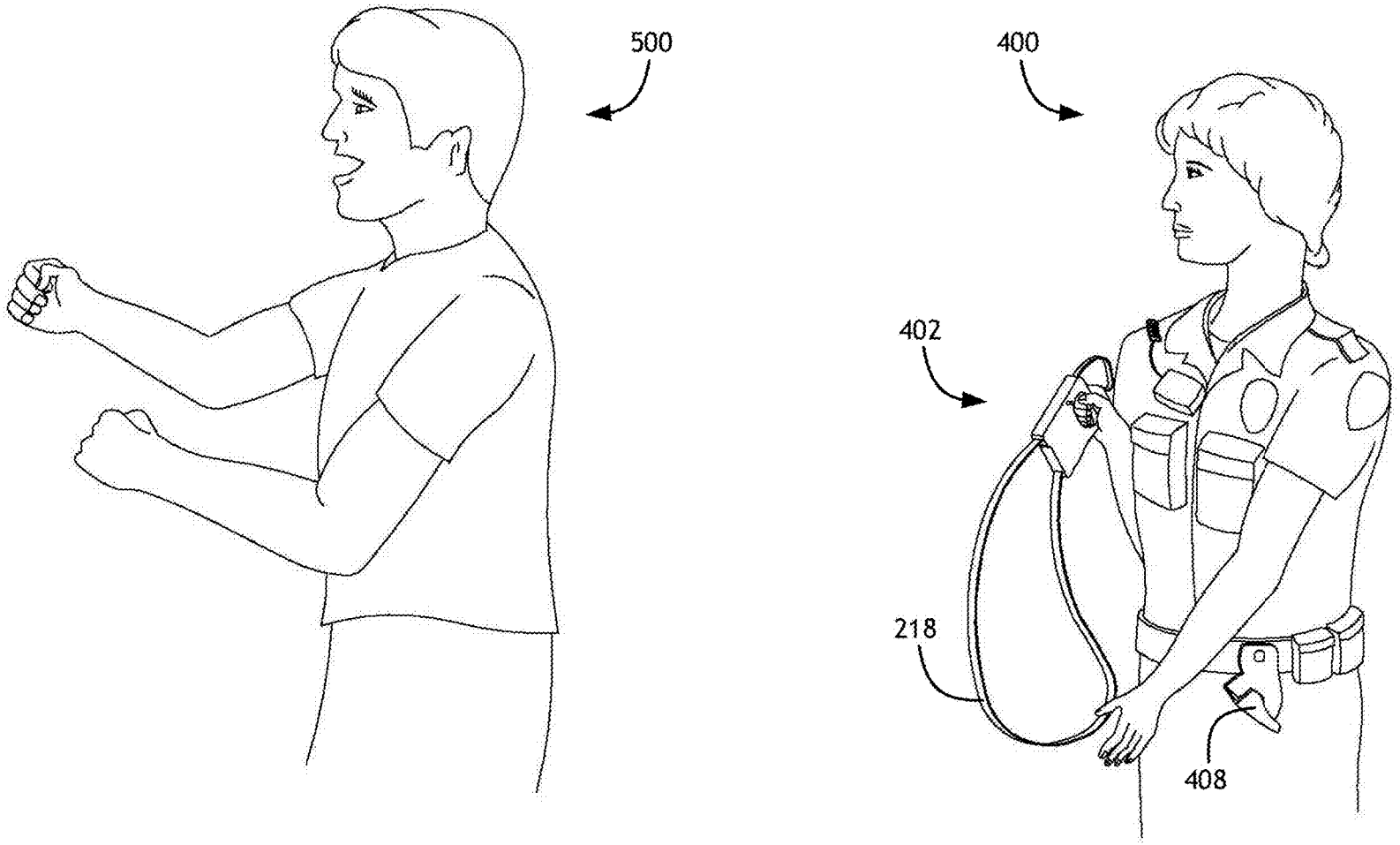
FIG. 6 shows another environmental view of a restraining device according to the present disclosure.
Figure 7:
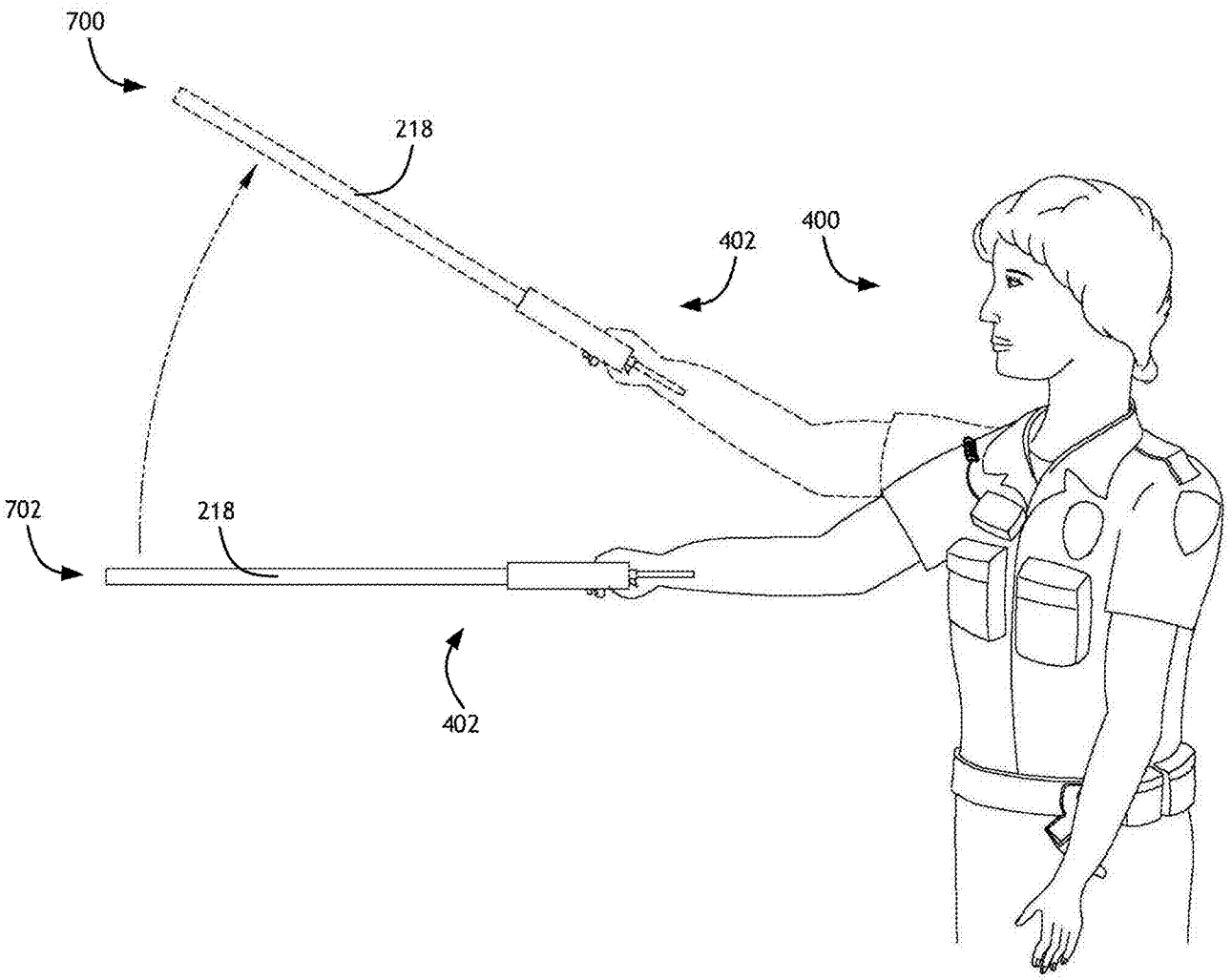
FIG. 7 shows another environmental view of a restraining device according to the present disclosure.
Figure 8:
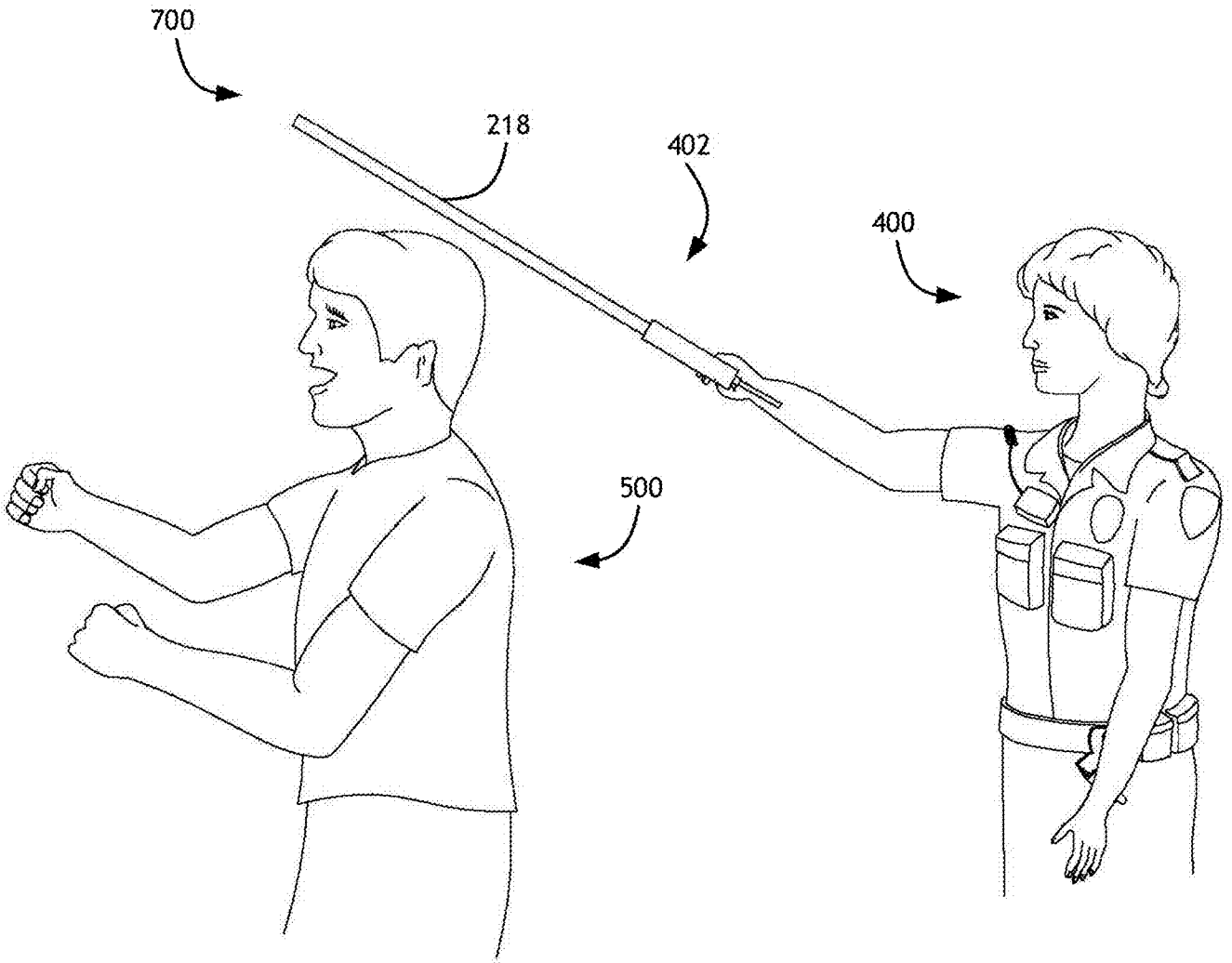
FIG. 8 shows another environmental view of a restraining device according to the present disclosure.

Referring to FIG. 6, another environmental view of a restraining device according to the present disclosure is shown. Once a police officer 400 determines that a person 500 is unarmed and in need of restraint, the police officer 400 removes the restraining device 402 from the holster 408 or clip and extends a flexible, extendable strap into a restraining loop 218. A person skilled in the art will appreciate that the holster 408 or clip is an exemplary mechanism for keeping the restraining device in an easily accessible orientation, and should not be limiting in any way.

Referring to FIGS. 7, 8, 9, and 10, environmental views of a restraining device according to the present disclosure are shown. The police officer 400 having extended the restraining loop 218 from the restraining device 402, the extended restraining device 402 is utilized by orienting the restraining loop 218 into a first orientation 700 over a person to be restrained, then into a second orientation 702 around the person to be restrained. The flexible, extendable strap comprising the flexible, extendable loop 218 is generally flexible in one dimension but substantially rigid in a second dimension, so that the restraining loop 218 remains well formed to place over the person being restrained in the second orientation 702.

When the restraining loop 218 is in the second orientation 702 around the person 500 being restrained, the person's arms 900, 902 are at least partially within the restraining loop 218. The police officer 400 may maintain the device body 100 at the back of the person 500 being restrained to help isolate the police officer 400 from harm as the police officer 400 tightens the restraining loop 218. The police officer 400 tightens the restraining loop 218 by pulling on the tightening handle 112. Pulling on the tightening handle 112 causes the flexible, extendable strap forming the restraining loop 218 to pass through a biasing element that prevents the restraining loop 218 from loosening once tightened.

Figure 11:
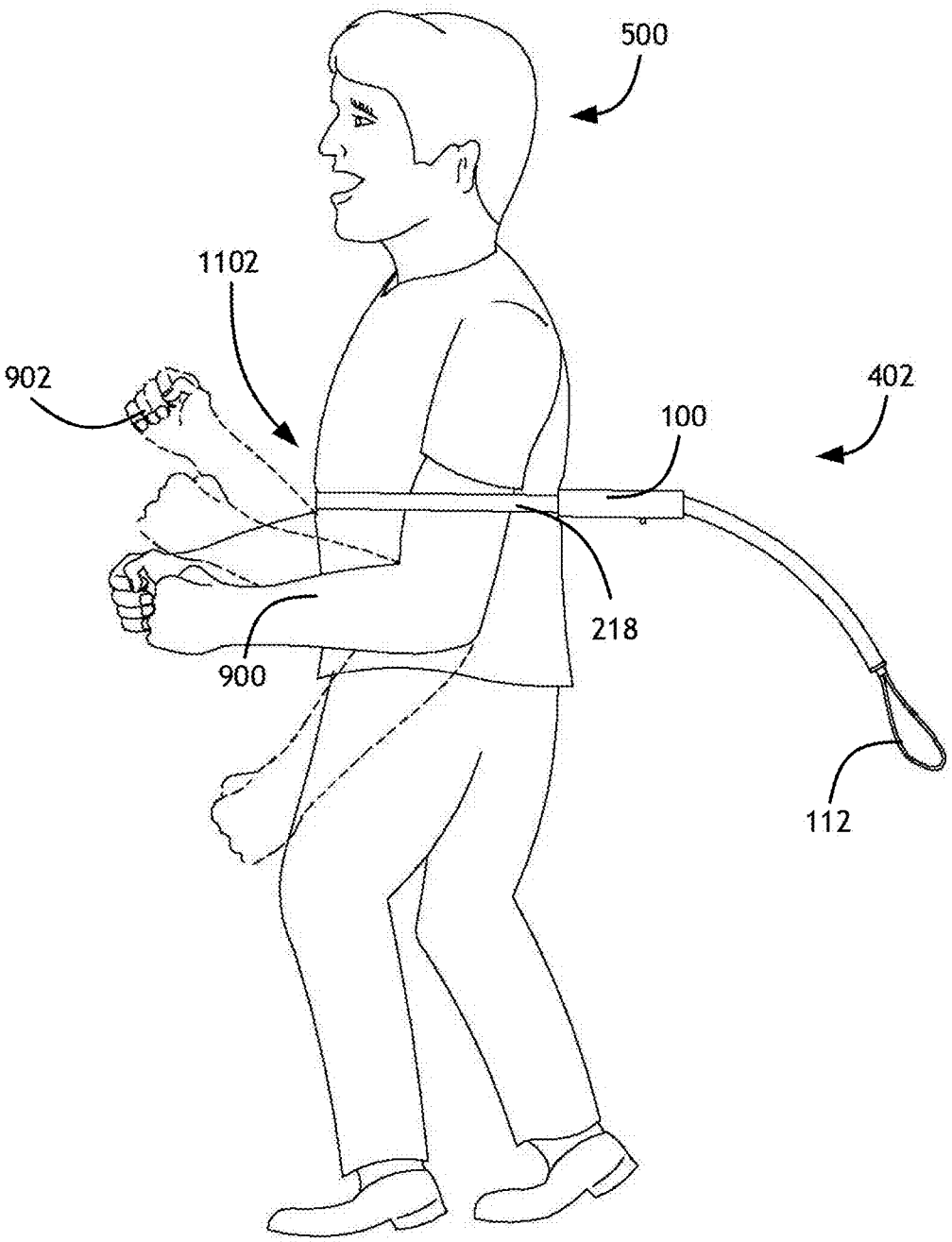
FIG. 11 shows another environmental view of a restraining device according to the present disclosure.

Referring to FIG. 11, another environmental view of a restraining device according to the present disclosure is shown. Once the restraining device 402 is tightened, the restraining loop forms a binding restraint 1102 on the person being restrained 500, with the person's arms 900, 902 largely immobilized. The device body 100, including the handle defined by the device body 100, may be maintained at the person's back so that a police officer may maintain a grip on the person 500 from behind. The police officer may also hold and apply additional force to the tightening handle 112 to further control the movement of the person 500. Furthermore, if the person 500 continues to be belligerent and uncooperative, the police officer may simply release the handle of the device body 100 to prevent injury to the person 500 or police officer, while continuing to restrain the arms 900, 902 of the person 500.

In an alternative deployment, the restraining loop may be tightened around the person's legs to immobilize the person 500. Likewise, the device may be used on the person's legs after the person's arms 900, 902 are immobilized. The person 500 may thereby be safely immobilized in stages without substantial risk to the person 500 or a police officer.

Figure 9:
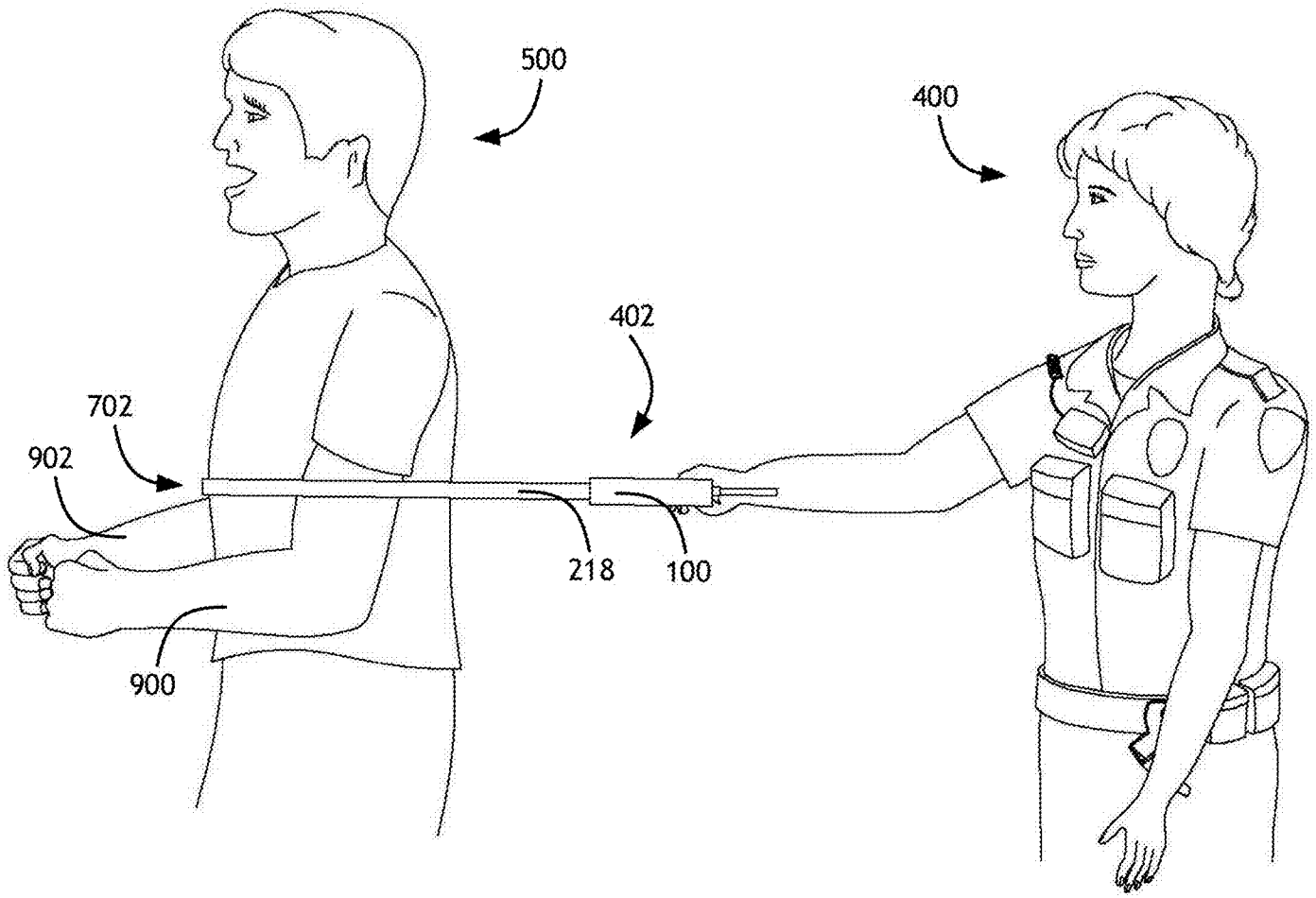
FIG. 9 shows another environmental view of a restraining device according to the present disclosure.
Figure 10:
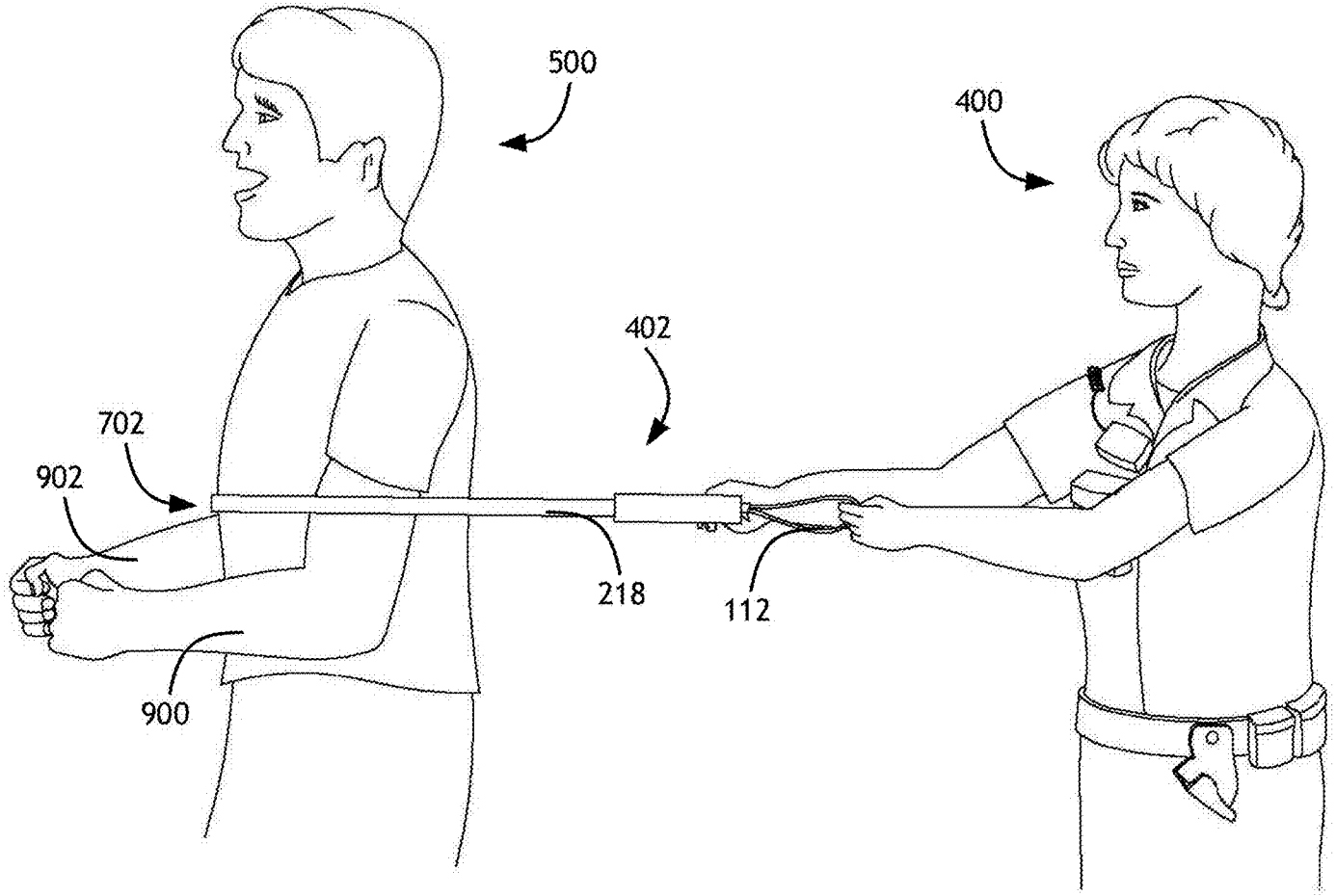
FIG. 10 shows another environmental view of a restraining device according to the present disclosure.

While FIGS. 9-11 show the person 500 being restrained about the arms 900, 902, a person skilled in the art will appreciate that the person 500 may restrained about any portion of the body that provides some form of physical restraint.

Figure 12:
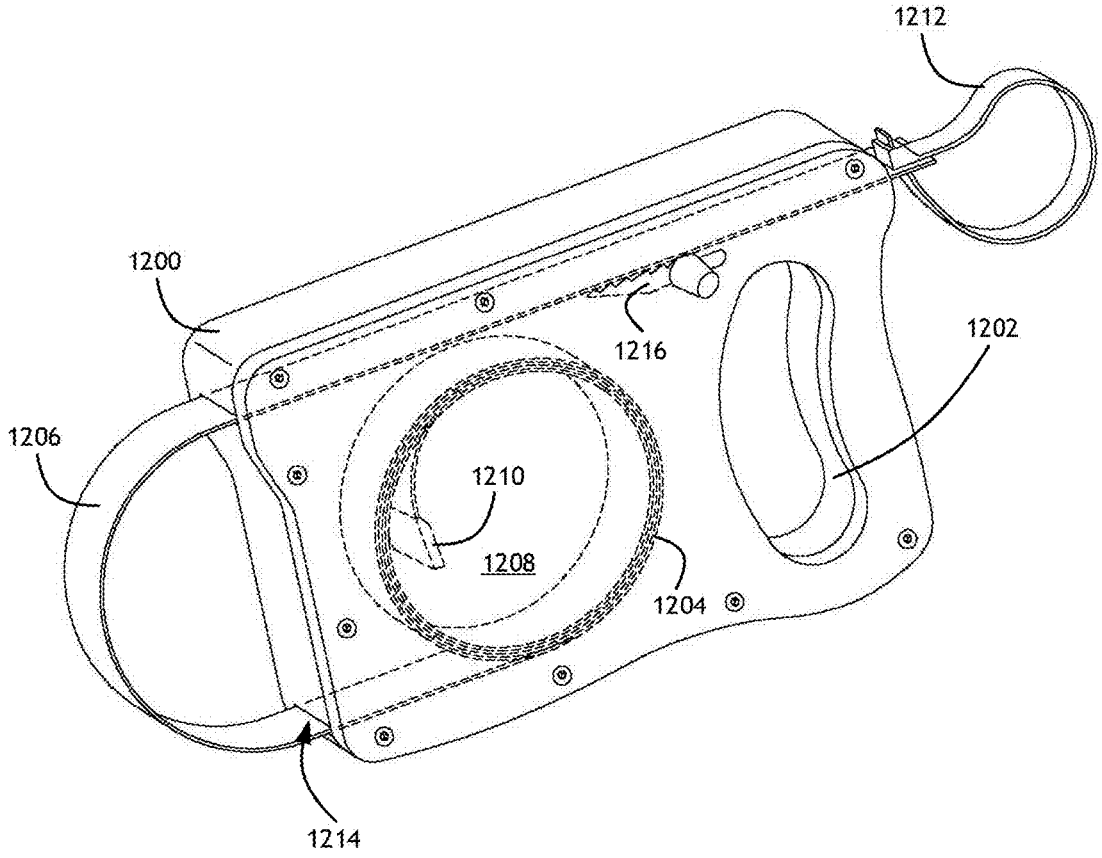
FIG. 12 shows a perspective view of an exemplary embodiment of a restraining device according to the present disclosure.

Referring to FIG. 12, a perspective view of an exemplary embodiment of a restraining device according to the present disclosure is shown. The restraining device includes a body 1200 defining a handle 1202 and a strap cavity 1208. A flexible, extendable strap 1204 is wound inside the strap cavity 1208 with a portion extending through a strap endstop retaining element 1214, forming an extension loop 1206, and passing back through the body 1200, connected to a handle 1212 which may include a solid ring or self-engaging tie. The strap endstop retaining element 1214 allows the flexible, extendable strap to pass through unopposed but prevents an endstop portion 1210 from passing through. A biasing element 1216 allows the flexible, extendable strap to pass though as the handle 1212 is pulled, but prevents the flexible, extendable strap from passing through in the opposite direction unless the biasing element 1216 is disengaged. In at least one embodiment, the biasing element 1216 may comprise a toothed element that may be spring biased.

Figure 13:
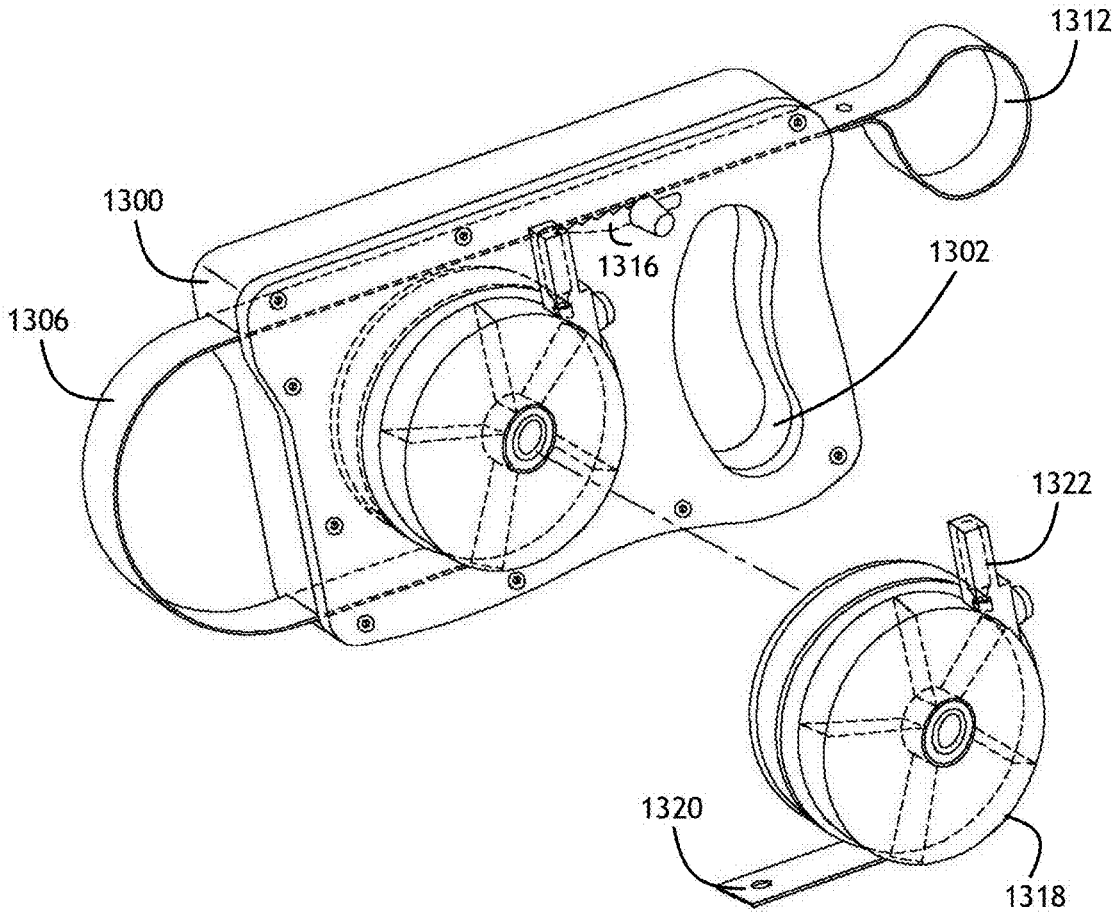
FIG. 13 shows a perspective view of an exemplary embodiment of a restraining device according to the present disclosure.

Referring to FIG. 13, a perspective view of an exemplary embodiment of a restraining device according to the present disclosure is shown. The restraining device includes a body 1300 defining a handle 1302 and a cartridge cavity. A replaceable cartridge 1318 contains a flexible, extendable strap 1320 stored in a coiled or rolled up state inside the replaceable cartridge 1318. The replaceable cartridge 1318 is inserted into the cartridge cavity with the flexible, extendable strap 1320 fed through an extending loop channel, forming an extending loop 1306, and fed through a retracting channel and biasing element 1316 to a tightening handle 1312.

The replaceable cartridge 1318 may include a locking mechanism 1322. The locking mechanism 1322 may lock the replaceable cartridge 1318 in the device body 1300 and/or lock the flexible, extendable strap 1320 inside the replaceable cartridge 1318 until inserted in to the device body 1300.

Figure 14:
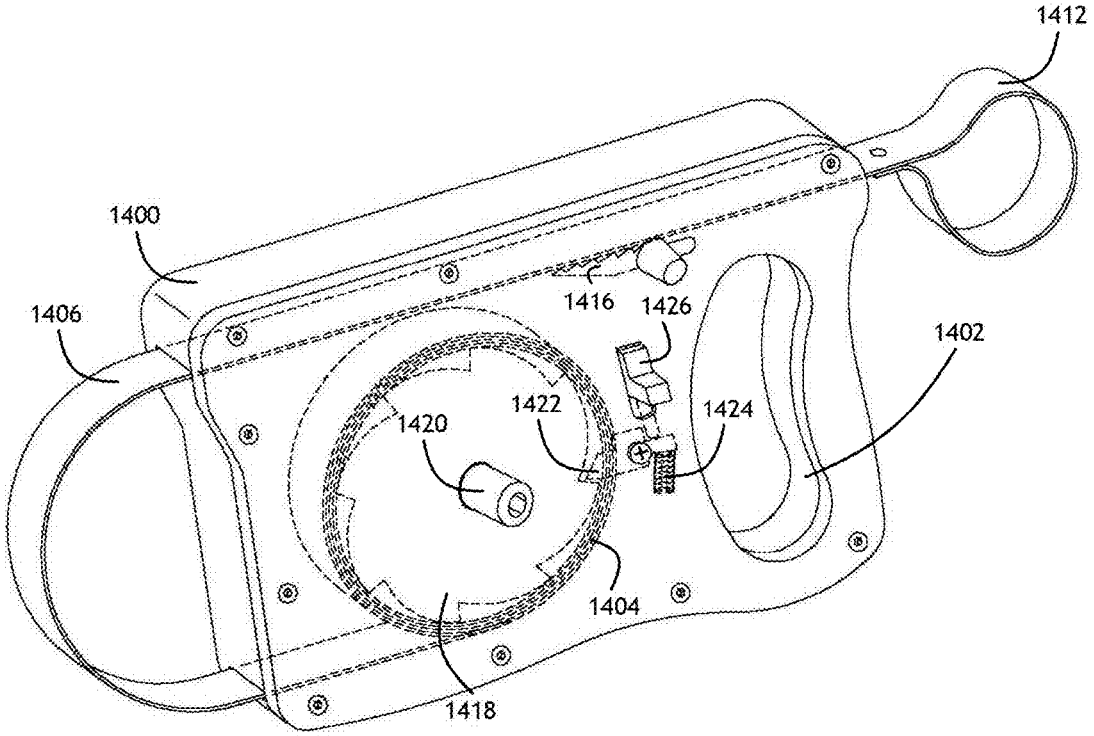
FIG. 14 shows a perspective view of an exemplary embodiment of a restraining device according to the present disclosure.

Referring to FIG. 14, a perspective view of an exemplary embodiment of a restraining device according to the present disclosure is shown. The restraining device includes a body 1400 defining a handle 1402 and a strap cavity containing a winding mechanism 1420. A flexible, extendable strap 1404 is wound inside the strap cavity via the winding mechanism 1420 with a portion extending through an extending channel, forming an extension loop 1406, and passing back through a retracting cavity to a tightening handle 1412. The winding mechanism 1420 prevents the flexible, extendable strap 1404 from extending too far so as to exit the device body 1400. A biasing element 1416 allows the flexible, extendable strap to pass though as the tightening handle 1412 is pulled, but prevents the flexible, extendable strap from passing through in the opposite direction unless the biasing element 1416 is disengaged.

The winding mechanism 1420 may be biased to wind in only one direction, such as via a toothed wheel. The teeth 1418 on the toothed wheel may engage a tooth lock 1422 that is biased via a spring 1424 to prevent counter-rotation of the winding mechanism 1420 unless the tooth lock 1422 is disengaged via a disengaging lever 1426.

Figure 15:
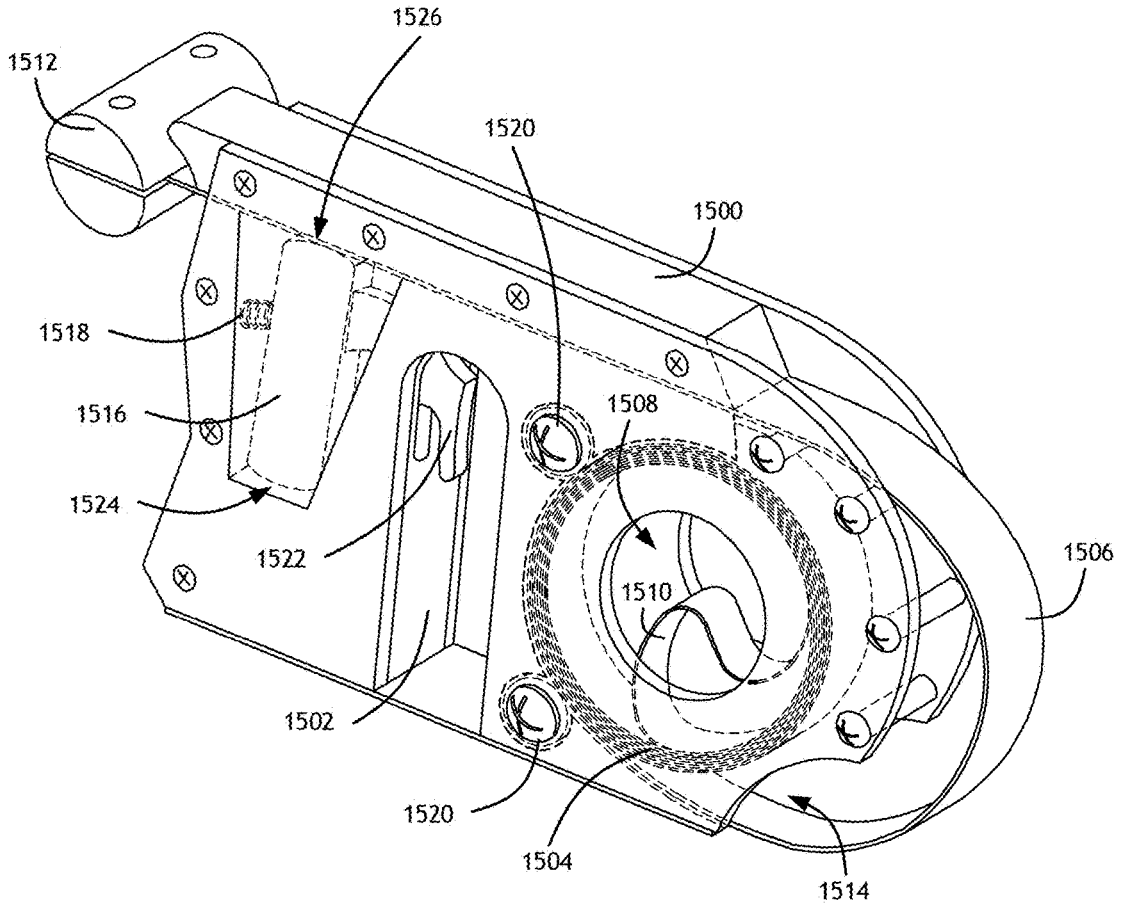
FIG. 15 shows a perspective view of an exemplary embodiment of a restraining device according to the present disclosure.

Referring to FIG. 15, a perspective view of an exemplary embodiment of a restraining device according to the present disclosure is shown. The restraining device includes a body 1500 defining a handle 1502 and a strap cavity 1508. A flexible, extendable strap 1504 is wound inside the strap cavity 1508 with a portion extending through an extending channel, forming an extension loop 1506, and affixed to a tightening handle 1512 that allows the user to apply a tensioning force to the flexible, extendable strap 1504. The device may also contain one or more bearings 1520 in the strap cavity 1508 to facilitate smooth extension of the flexible, extendable strap 1504 through an endstop restraining portion 1514 that defines a channel to prevent passage of an endstop portion 1510. In at least one embodiment, the endstop portion 1510 may comprise a loop in the flexible, extendable strap 1504 that further facilitates winding the flexible, extendable strap 1504 back into the strap cavity 1508 after use.

In at least one embodiment, the restraining device includes a spring cam biasing element 1516. A cam housing defined by the body 1500 provides a bottom surface to engage a first lobe 1524 of the cam biasing element 1516, and allows access to the flexible, extendable strap 1504 passing through the body 1500, to apply a force and wedge the flexible, extendable strap 1504 between a second lobe 1526 of the cam biasing element 1516 and the body 1500. Each of the first lobe 1524 and second lobe 1526 define cam profiles having lifts sufficient to wedge the flexible, extendable strap 1504. The profiles of the first lobe 1524 and second lobe 1526 may be similar or disparate as necessary to achieve the desired wedging force. A cam spring 1518 generally biases the cam biasing element 1516 into an orientation to allow a user to pull on the tightening handle 1512 and tighten the flexible, extendable strap 1504, but does not allow the flexible, extendable strap 1504 to be loosened.

The restraining device may include a release 1522 for manually pushing the cam biasing element 1516 into an orientation that allows the flexible, extendable strap 1504 to loosen; that is to say, release the wedging force.

Figure 16:
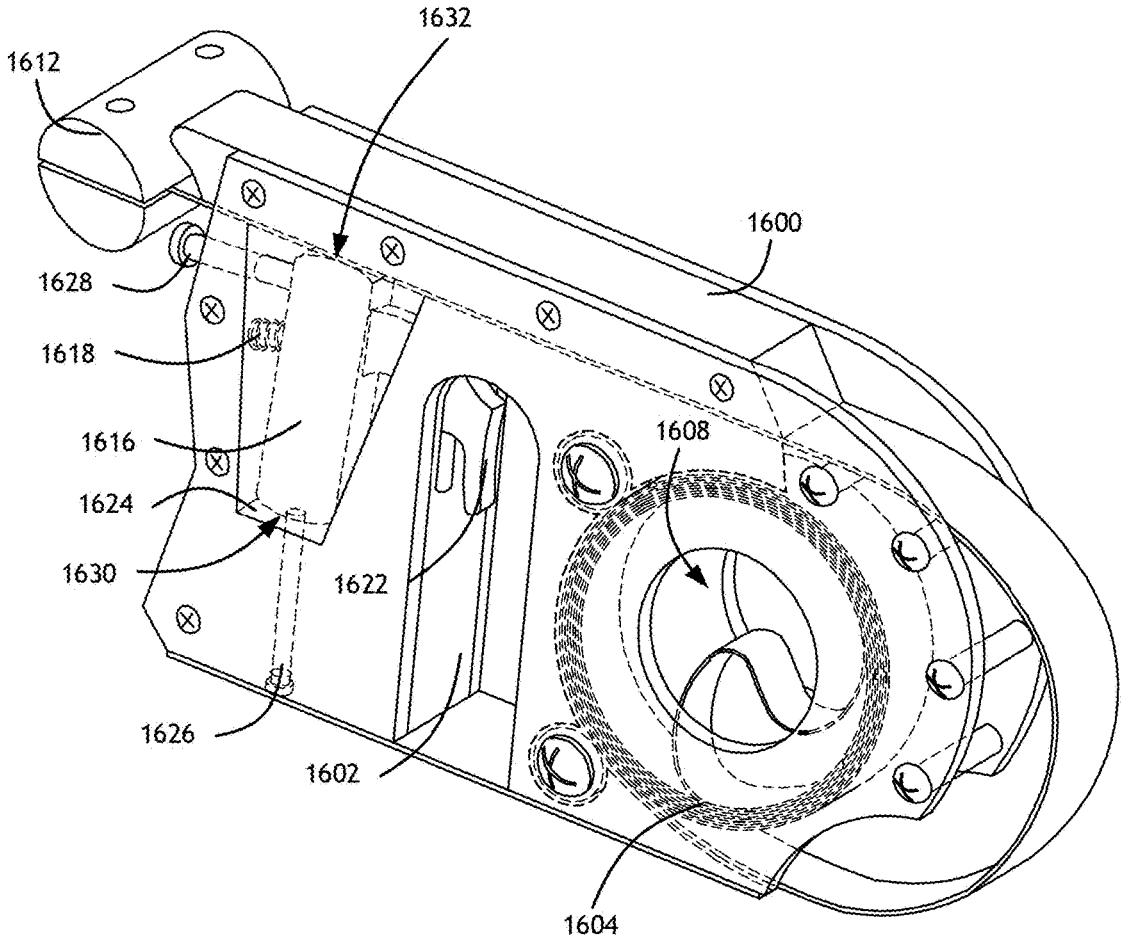
FIG. 16 shows a perspective view of an exemplary embodiment of a restraining device according to the present disclosure.

Referring to FIG. 16, a perspective view of an exemplary embodiment of a restraining device according to the present disclosure is shown. Where the restraining device includes a body 1600 defining a handle 1602 and a strap cavity 1608 containing a flexible, extendable strap 1604 biased by a spring cam biasing element 1616, it may be desirable to adjust the force applied the flexible, extendable strap 1604 by the cam biasing element 1616.

A cam housing defined by the body 1600 provides a bottom surface 1624 or adjustable bottom plate to engage a first lobe 1630 of the cam biasing element 1616, and allows access to the flexible, extendable strap 1604 passing through the body 1600, to apply a force and wedge the flexible, extendable strap 1604 between a second lobe 1632 of the cam biasing element 1616 and the body 1600. The position of the first contact surface may be adjusted by adjusting means 1626 such as a screw, cam lever, insertable plates, or any other similar means. Likewise, such adjusting means 1626 may adjust the position of the adjustable bottom plate which has the effect of changing the location of the interface between the first lobe 1630 and the adjustable bottom plate and altering the effect of the lift defined by the profile of the first lobe 1630.

Where a cam spring 1618 generally biases the cam biasing element 1616 into an orientation to allows a user to pull on the tightening handle 1612 and tighten the flexible, extendable strap 1604, it may be desirable to induce the cam biasing element 1616 to apply more force to the flexible, extendable strap 1604 than is applied by the cam spring 1618 alone. An additional pressure mechanism 1628 may be useful for pushing the cam biasing element 1616 in a direction to manually apply additional force to the flexible, extendable strap 1604. Such additional pressure mechanism 1628 may comprise a pushrod, cam lever or other such means, and may also include a releasable ratcheting element to temporarily maintain the additional force.

The restraining device may include a release 1622 for manually pushing the cam biasing element 1616 into an orientation that allows the flexible, extendable strap 1604 to loosen. Such release 1622 may also release or otherwise deactivate the additional pressure mechanism 1628 where necessary.

Figure 17:
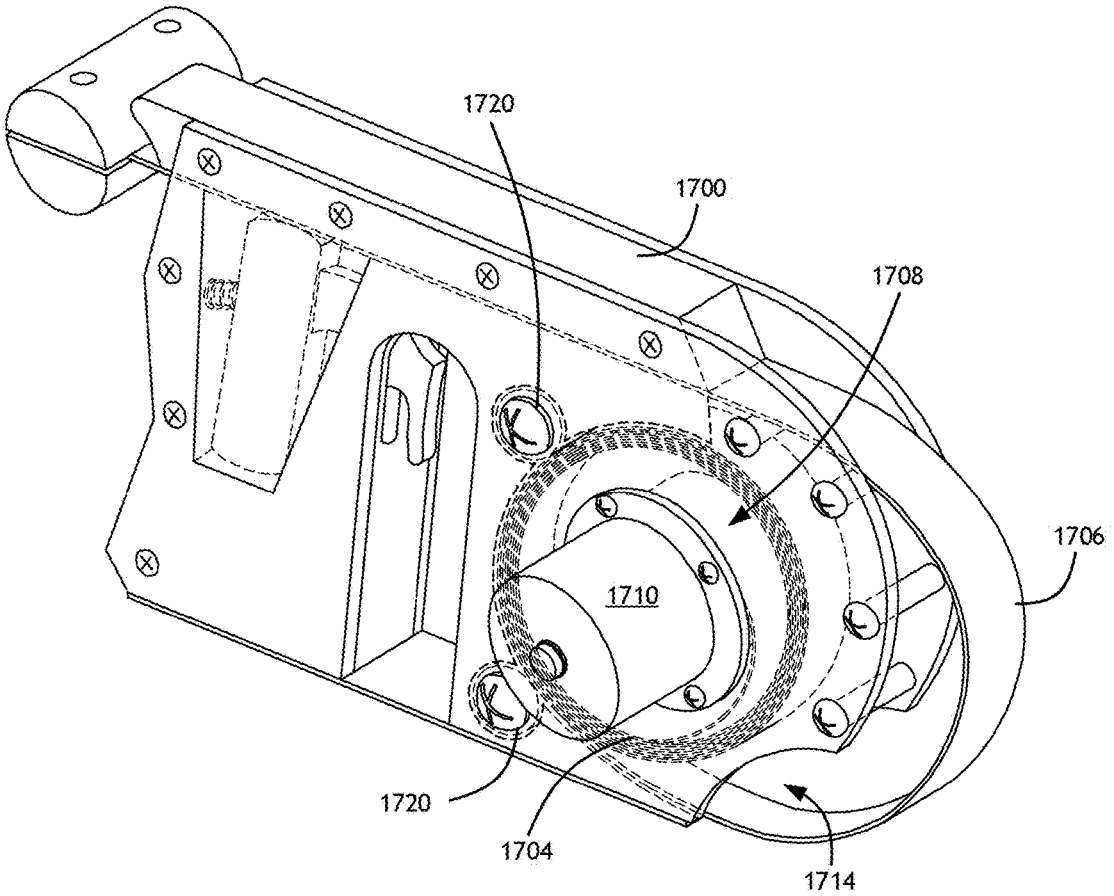
FIG. 17 shows a perspective view of an exemplary embodiment of a restraining device according to the present disclosure.

Referring to FIG. 17, a perspective view of an exemplary embodiment of a restraining device according to the present disclosure is shown. The restraining device includes a body 1700 defining a strap cavity 1708 containing a flexible, extendable strap 1704, with a portion forming an extension loop 1706. The device may also contain one or more bearings 1720 in the strap cavity 1708 to facilitate smooth extension of the flexible, extendable strap 1704 through an endstop restraining portion 1714 that defines a channel to prevent passage of an endstop portion.

Alternatively, or in addition, the end strap portion may be affixed to a motor 1710. The motor 1710 is configured to wind the flexible, extendable strap 1704 back into the strap cavity 1708 after deployment. In at least one embodiment, the motor 1710 may also be configured to deploy the flexible, extendable strap 1704 into a large extension loop 1706.

Figure 18:
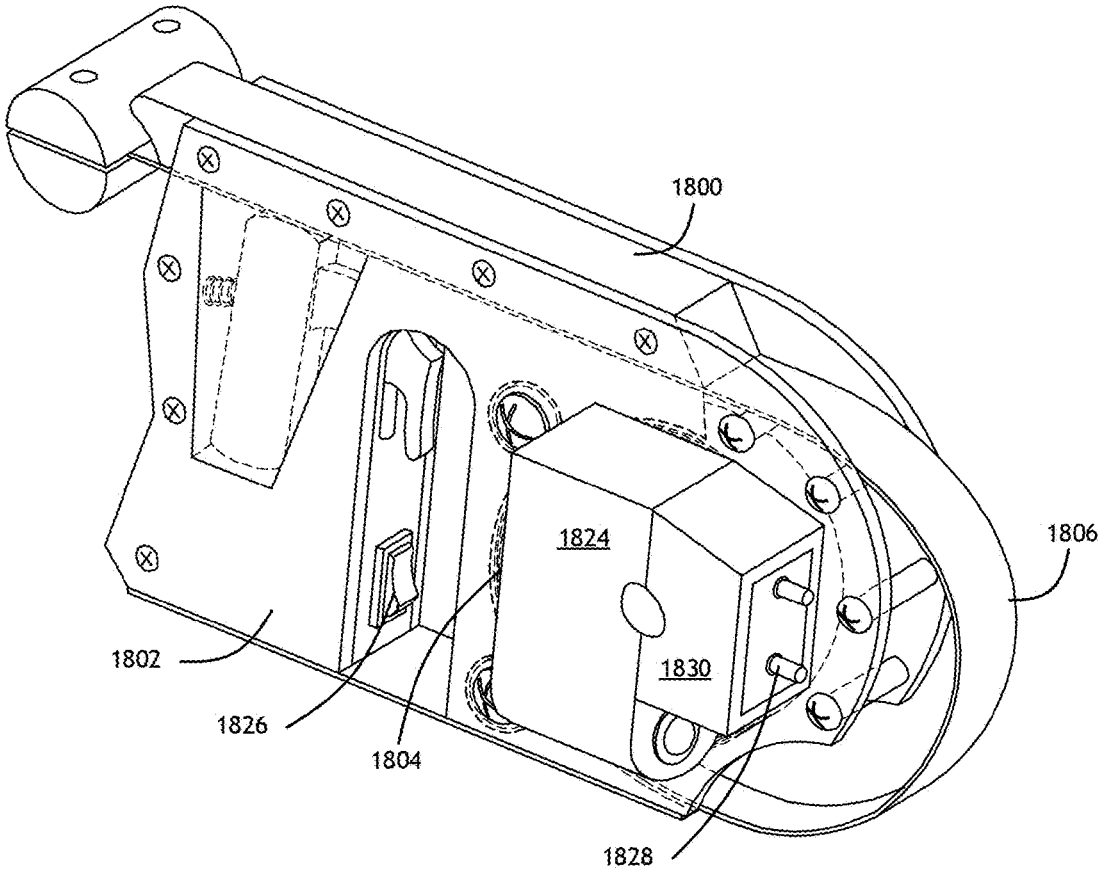
FIG. 18 shows a perspective view of an exemplary embodiment of a restraining device according to the present disclosure.

Referring to FIG. 18, a perspective view of an exemplary embodiment of a restraining device according to the present disclosure is shown. The restraining device includes a body 1800 defining a strap cavity containing a flexible, extendable strap 1804, with a portion forming an extension loop 1806. In ordinary usage, the extension loop 1806 is extended to encircle a person to be restrained, and the flexible, extendable strap 1804 is tightened as described herein. Tightening the flexible, extendable strap 1804 tends to bring a leading edge of the body 1800 in contact with the person being restrained.

In at least one embodiment, a less than lethal immobilizing device 1824 is disposed on the body 1800 such that a functional element 1828 of the less than lethal immobilizing device 1824 extends from the leading edge to contact the person being restrained. The less than lethal immobilizing device 1824 may comprise an electrically operable stun device. Such electrically operable stun device may be activated by a switch 1826 disposed within a handle 1802 defined by the body 1800.

Alternatively, the less than lethal immobilizing device 1824 may comprise a chemical tranquilizer. Chemical tranquilizers are generally unsafe because effective dosages are difficult or impossible to determine, especially in a tense situation where a restraining device is called for. However, when used in conjunction with a physical restraining device, a known safe dosage may be predetermined because the goal is relative placidity rather than unconsciousness.

Alternatively, the less than lethal immobilizing device 1824 may comprise a strobe device. Such strobe device may be activated prior to deployment of the extension loop 1806 to disorient the person being restrained and thereby facilitate restraint of the person.

The less than lethal immobilizing device 1824 may include a replaceable cartridge 1830. The replaceable cartridge 1830 is a one-time use device.

Figure 19:
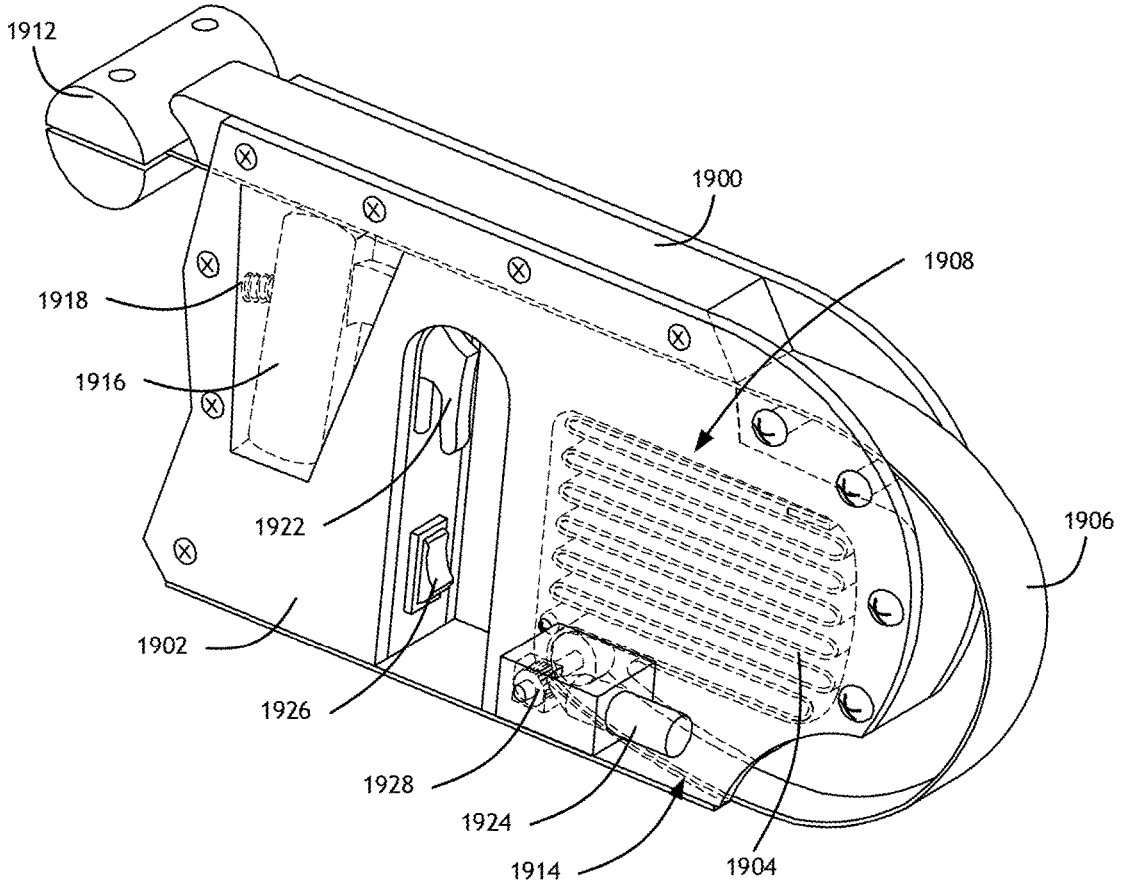
FIG. 19 shows a perspective view of an exemplary embodiment of a restraining device according to the present disclosure.

Referring to FIG. 19, a perspective view of an exemplary embodiment of a restraining device according to the present disclosure is shown. The restraining device includes a body 1900 defining a handle 1902 and a strap cavity 1908 where an inflatable strap 1904 is coiled or otherwise folded with a portion extending through a extending channel 1914, forming an extension loop 1906, and affixed to a tightening handle 1912 that allows the user to apply a tensioning force to the inflatable strap 1904. The inflatable strap 1904 may be inflated by a $CO_2$ cartridge 1924.

In some embodiments, where the inflatable strap 1904 is coiled within the strap cavity 1908 so as to deploy from the strap cavity when pushed out by the force of inflation, a switch 1926 disposed in the handle 1902 may activate the $CO_2$ cartridge 1924. When the inflatable strap 1904 is inflated, it may form a rigid or semi-rigid loop. When the inflated loop is placed over a person to be restrained, a tensioning force applied to the handle 1912 may force the $CO_2$ from the inflatable strap 1904 as it passed through the body 1900 and held in place in a biasing element 1916.

In at least one embodiment, a portion of the inflatable strap 1904 may be configured to engage an auto-inflating device 1928 when the inflatable strap 1904 is manually unspooled.

In at least one embodiment, the biasing element 1916 may comprise a cam biasing element and a spring 1918 to force the cam biasing element 1916 into an orientation to wedge the inflatable strap 1904 against the body 1900 but allow the inflatable strap 1904 to continue to be tightened by pulling on the handle 1912. The restraining device may include a release 1922 for manually pushing the cam biasing element 1916 into an orientation that allows the inflatable strap 1904 to loosen.

Figure 20:
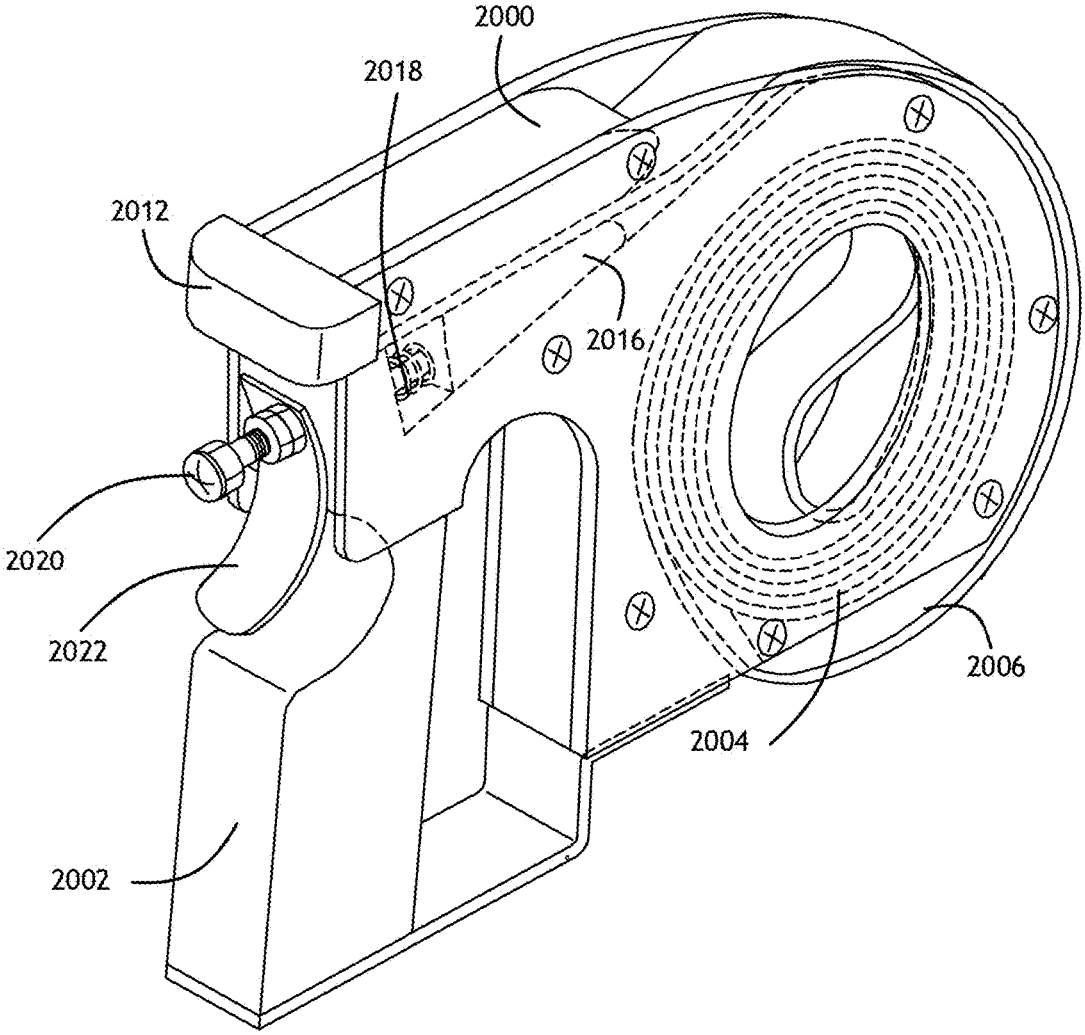
FIG. 20 shows a perspective view of an exemplary embodiment of a restraining device according to the present disclosure.

Referring to FIG. 20, a perspective view of an exemplary embodiment of a restraining device according to the present disclosure is shown. The restraining device includes a body 2000 defining a handle 2002 and a strap cavity containing a flexible, extendable strap 2004 with a portion extending through an extending channel, forming an extension loop 2006, and affixed to a tightening handle 2012 that allows the user to apply a tensioning force to the flexible, extendable strap 2004.

In at least one embodiment, the restraining device includes a spring wedge biasing element 2016 within a wedge housing defined by the body 2000 that provides a surface to engage a bottom surface of the wedge biasing element 2016 and force the wedge biasing element 2016 into contact with the flexible, extendable strap 2004. In at least one embodiment, a top surface of the wedge biasing element 2016 may include a friction enhancing element such as knurling or any other texturing configured increase friction between the wedge biasing element 2016 and the flexible, extendable strap 2004 such that when a force is applied to the flexible, extendable strap 2004 that would tend to loosen the flexible, extendable strap 2004, such force tends to pull the wedge biasing element 2016 to further increase the wedging force applied by the wedge biasing element 2016 to the flexible, extendable strap 2004.

A biasing spring 2018 generally biases the wedge biasing element 2016 into an orientation to allow a user to pull on the tightening handle 2012 and tighten the flexible, extendable strap 2004, but does not allow the flexible, extendable strap 2004 to be loosened. The biasing spring 2018 may be adjustable via a biasing force adjusting element 2020, such as a screw configured to increase or decrease the resting force applied to the wedge biasing element 2016.

The restraining device may include a release 2022 for manually pulling the wedge biasing element 2016 into an orientation that allows the flexible, extendable strap 2004 to loosen.

Figure 21:
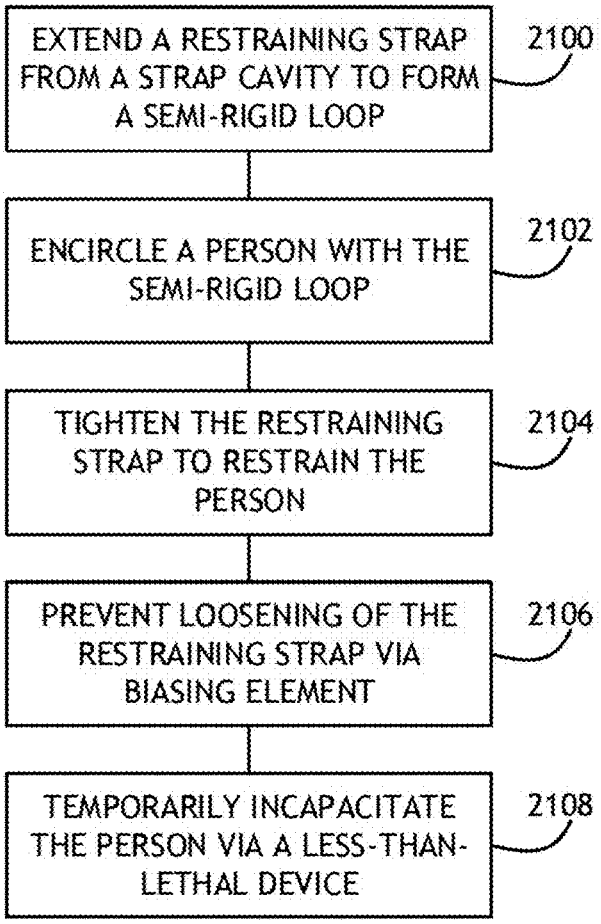
FIG. 21 shows a flowchart for a method of restraining a person according to the present disclosure.

Referring to FIG. 21, a flowchart for a method of restraining a person according to the present disclosure is shown. A restraining device according to embodiments of the present disclosure may be used to restrain a person by extending 2100 a restraining strap from a strap cavity to form a semi-rigid loop. The semi-rigid loop is then used to encircle 2102 a person. The strap is tightened 2104 to restrain the person, and the strap is prevented 2106 from loosening by a biasing element. In some embodiments, the person may be temporarily incapacitated 2108 by a less-than-lethal device disposed on the restraining device.

It is believed that the inventive concepts disclosed herein and many of their attendant advantages will be understood by the foregoing description of embodiments of the inventive concepts disclosed, and it will be apparent that various changes may be made in the form, construction, and arrangement of the components thereof without departing from the broad scope of the inventive concepts disclosed herein or without sacrificing all of their material advantages. For example, various features of each disclosed embodiment may be combined with alternative embodiments without departing from the principles of the invention. The form herein before described being merely an explanatory embodiment thereof, it is the intention of the following claims to encompass and include such changes.

What is claimed is:

1. An apparatus for restraining a person comprising:

a device body defining a handle, an extending channel, a retracting channel, and a strap winding cavity;

a restraining strap having a rectangular cross-section flexible in a first dimension to allow the restraining strap to be wound within the strap winding cavity and rigid in a second dimension to form a restraining loop, the restraining strap configured to pass through the extending channel and the retracting channel, and remain disposed in said extending channel and retracting channel;

a tightening handle disposed on a first terminus of the restraining strap configured to prevent the restraining strap from leaving the retracting channel;

and endstop portion disposed on a second terminus of the restraining strap; and a biasing element configured to allow the restraining strap to move in one direction through the retracting channel to tighten the restraining loop about said person's upper arms and restrict arm movement, wherein the restraining strap is deployable from a stored configuration where the restraining strap is wound within the strap winding cavity to a deployed configuration where the restraining strap is unwound into the rigid restraining loop by applying a force to a portion of the restraining strap between the extending channel and retracting channel so that the restraining strap is unwound through the extending channel while stationary in the retracting channel until the endstop portion abuts a surface of the strap winding cavity.

2. The restraining apparatus of claim 1, further comprising a motor, disposed on the device body, configured to wind the restraining strap into a channel.

3. The restraining apparatus of claim 1, further comprising a stun device, disposed on the device body such that the stun device is configured to physically contact a person restrained by the restraining strap.

4. The restraining apparatus of claim 1, wherein the biasing element is a cam biasing element.

5. The restraining apparatus of claim 4, further comprising an adjusting screw disposed in the device body, the adjusting screw configured to alter the position of a contact surface abutting a portion of the cam biasing element.

6. The restraining apparatus of claim 4, further comprising a pushrod configured to manually apply a force to the cam biasing element.

7. The restraining apparatus of claim 1, wherein the biasing element is a sprung toothed element.

8. The restraining apparatus of claim 1, wherein the restraining strap comprises an inflatable strap, and further comprising a CO2 cartridge configured to inflate the inflatable strap.

9. An apparatus for restraining a person comprising:

a device body defining a handle, an extending channel, and a retracting channel, and a strap winding cavity;

a restraining means having a rectangular cross-section flexible in a first dimension to allow the restraining means to be wound within the strap winding cavity and rigid in a second dimension to form a restraining loop, the restraining means configured to pass through the extending channel and the retracting channel, and remain disposed in said extending channel and retracting channel;

a tightening means disposed on a terminus of the restraining means configured to prevent the restraining means from leaving the retracting channel;

and endstop portion disposed on a second terminus of the restraining means; and a biasing means configured to allow the restraining strap to move in one direction through the retracting channel to tighten the restraining means about said person's upper arms and restrict arm movement, wherein the restraining means is deployable from a stored configuration where the restraining means is wound within the strap winding cavity to a deployed configuration where the restraining means is unwound into the rigid restraining loop by applying a force to a portion of the restraining strap between the extending channel and retracting channel so that the restraining means is unwound through the extending channel while stationary in the retracting channel until the endstop portion abuts a surface of the strap winding cavity.

10. The restraining apparatus of claim 9, further comprising an automatic winding means, disposed on the device body, configured to wind the restraining means.

11. The restraining apparatus of claim 9, further comprising an incapacitation means, disposed on the device body, configured to at least partially incapacitate a person restrained by the restraining strap.

12. The restraining apparatus of claim 9, wherein the biasing means is a cam biasing element having a first lobe 1524 and a second lobe 1526.

13. The restraining apparatus of claim 12, further comprising a cam adjusting means defined by the device body, the cam adjusting means configured to alter the position of a contact surface abutting the first lobe 1524.

14. The restraining apparatus of claim 12, further comprising a cam wedging means configured to manually apply a force to the cam biasing element.

15. The restraining apparatus of claim 9, wherein the restraining means is an inflatable element, configured to form a semi-rigid loop when inflated.

16. A method for restraining a person comprising:

extending a restraining strap comprising a tightening handle disposed on a first terminus to prevent the restraining strap from leaving a retracting channel and an endstop portion disposed at a second terminus to prevent the restraining strap from leaving an extending channel, the restraining strap having a rectangular cross-section flexible in a first dimension to allow the restraining strap to be wound within a strap winding cavity and rigid in a second dimension to form a semi-rigid loop by unwinding the restraining strap from the strap winding cavity by applying a force to a portion of the restraining strap between the extending channel and retracting channel so that the restraining strap is unwound through the extending channel while stationary in the retracting channel until the endstop portion abuts a surface of the strap winding cavity;

encircling a person with the semi-rigid loop about said person's upper arms; and tightening the semi-rigid loop to restrain the person and restrict arm movement by applying a force to the tightening handle while the restraining strap remains stationary in the extending channel, wherein the semi-rigid loop is retained in an orientation restraining the person by a biasing element configured to prevent loosening of the restraining strap.

17. The method of claim 16, further comprising releasing the biasing element to loosen the restraining strap.

18. The method of claim 16, further comprising inflating the restraining strap.

19. The method of claim 16, further comprising temporarily incapacitating the person with a less-than-lethal device.

20. The method of claim 16, further comprising winding the restraining strap back into a strap winding cavity.

* * * * *